US010653913B2

(12) United States Patent
Yao et al.

(10) Patent No.: US 10,653,913 B2
(45) Date of Patent: May 19, 2020

(54) STEPPING EXERCISE MACHINE

(71) Applicant: Chung-Fu Chang, Changhua County (TW)

(72) Inventors: Ku-Feng Yao, Jinhua (CN); Hui-Nan Yu, Jinhua (CN)

(73) Assignee: Chung-Fu Chang, Changhua County (TW)

( * ) Notice: Subject to any disclaimer, the term of this patent is extended or adjusted under 35 U.S.C. 154(b) by 136 days.

(21) Appl. No.: 15/644,548

(22) Filed: Jul. 7, 2017

(65) Prior Publication Data

US 2018/0133543 A1 May 17, 2018

(30) Foreign Application Priority Data

Nov. 16, 2016 (CN) ..... 2016 2 1230921 U

(51) Int. Cl.

| | |
|---|---|
| ***A63B 22/00*** | (2006.01) |
| ***A63B 23/04*** | (2006.01) |
| ***A63B 21/055*** | (2006.01) |
| ***A63B 21/00*** | (2006.01) |
| ***A63B 22/20*** | (2006.01) |
| ***A63B 69/00*** | (2006.01) |

(52) U.S. Cl.

CPC ..... *A63B 22/0046* (2013.01); *A63B 21/055* (2013.01); *A63B 21/0557* (2013.01); *A63B 21/4034* (2015.10); *A63B 22/0025* (2015.10); *A63B 22/0048* (2013.01); *A63B 22/20* (2013.01); *A63B 23/04* (2013.01); *A63B 23/0405* (2013.01); *A63B 69/0022* (2013.01); *A63B 69/0093* (2013.01); *A63B 2210/50* (2013.01); *A63B 2244/18* (2013.01)

(58) Field of Classification Search

CPC ..... A63B 22/0048; A63B 22/04; A63B 21/02–0557; A63B 22/20–208; A63B 22/0056–0069; A63B 69/18

See application file for complete search history.

(56) References Cited

U.S. PATENT DOCUMENTS

| | | | | | |
|---|---|---|---|---|---|
| 3,524,641 | A * | 8/1970 | Ossenkop | ..... | A63B 69/18 482/71 |
| 4,743,014 | A * | 5/1988 | Loane | ..... | A63B 69/18 482/130 |
| 5,020,793 | A * | 6/1991 | Loane | ..... | A63B 69/18 434/253 |
| 5,222,928 | A * | 6/1993 | Yacullo | ..... | A63B 21/023 482/51 |

(Continued)

*Primary Examiner* — Nyca T Nguyen

(74) *Attorney, Agent, or Firm* — Damian K. Jackson; Jackson IPG PLLC

(57) ABSTRACT

A stepping exercise machine includes a base and a pedal. The base is provided with an undulating slide rail. A top end of the slide rail is defined as a peak. Bottom ends of two sides of the peak are defined as troughs. The two sides of the peak or the bottom ends of the troughs are provided with stop blocks, respectively. An underside of the pedal is pivotally connected with rollers. Two sides of the underside of the pedal are fixedly connected with a pair of stretchable elastic members. The other ends of the pair of stretchable elastic members are fixed to two sides of the base. The rollers support and drive the pedal to reciprocate along the undulating slide rail ups and downs by means of the stretchable elastic members.

6 Claims, 6 Drawing Sheets

(56) References Cited

U.S. PATENT DOCUMENTS

| | | | | | |
|---|---|---|---|---|---|
| 5,582,567 | A * | 12/1996 | Chang | A63B 22/16 | 482/132 |
| 5,755,651 | A * | 5/1998 | Homyonfer | A63B 22/16 | 482/123 |
| 6,709,367 | B1 * | 3/2004 | Liang | A63B 22/0058 | 482/146 |
| 6,796,928 | B1 * | 9/2004 | Christopher | A63B 22/0056 | 482/123 |
| 7,901,332 | B1 * | 3/2011 | Wen | A63B 22/205 | 482/51 |
| 9,586,079 | B1 * | 3/2017 | Jones | A63B 21/0552 | |
| 2004/0241631 | A1 * | 12/2004 | Nizamuddin | A63B 21/055 | 434/253 |
| 2004/0242381 | A1 * | 12/2004 | Parmater | A63B 22/205 | 482/71 |
| 2005/0130815 | A1 * | 6/2005 | Abdoli-Eramaki | A61F 5/026 | 482/121 |
| 2005/0209058 | A1 * | 9/2005 | Yu | A63B 22/0056 | 482/52 |
| 2007/0232458 | A1 * | 10/2007 | Liao | A63B 21/159 | 482/52 |
| 2008/0287263 | A1 * | 11/2008 | Cheng | A63B 21/0087 | 482/9 |
| 2010/0190621 | A1 * | 7/2010 | Palmer | A63B 21/0552 | 482/121 |
| 2012/0053019 | A1 * | 3/2012 | Reyes | A63B 21/00069 | 482/52 |
| 2012/0277075 | A1 * | 11/2012 | Ho | A63B 17/00 | 482/141 |
| 2014/0162860 | A1 * | 6/2014 | Yang | A63B 69/04 | 482/146 |

* cited by examiner

STEPPING EXERCISE MACHINE

FIELD OF THE INVENTION

The present invention relates to fitness equipment, and more particularly to a stepping exercise machine.

BACKGROUND OF THE INVENTION

A stepping exercise machine is common fitness equipment. In general, a stepping exercise machine is suitable for some people unable to exercise a lot, especially the elderly. A conventional stepping exercise machine can assist the user in swinging left and right like running, thereby enhancing the strength of exercise, enhancing a full-body workout, effectively exercising the lower body and upper body, including the abdomen and heart, effectively enhancing the cardiopulmonary function, reducing the fat of the abdomen, waist, buttocks and legs, and shaping the buttocks, thighs and body.

The conventional stepping exercise machine includes a base and a pedal connected with the base. The linkage structure of this stepping exercise machine is complicated, so the stepping exercise machine is relatively heavy and large in size. The installation is time-consuming and laborious. It is inconvenient for carrying the stepping exercise machine. Besides, the stepping exercise machine occupies a lot of space. These are unfavorable for popularization and application of the stepping exercise machine. Accordingly, the inventor of the present invention has devoted himself based on his many years of practical experiences to solve these problems.

SUMMARY OF THE INVENTION

The primary object of the present invention is to provide a stepping exercise machine. The stepping exercise machine has the advantages of labor-saving installation, easy disassembly and so on, and can effectively improve the strength of exercise.

In order to achieve the aforesaid object, the stepping exercise machine of the present invention comprises a base and a pedal. The base is provided with an undulating slide rail. The undulating slide rail has a peak and two troughs at two sides of the peak. The two sides of the peak or the bottom ends of the troughs of the slide rail are provided with stop blocks, respectively. An underside of the pedal is pivotally connected with rollers. Two sides of the underside of the pedal are fixedly connected with a pair of stretchable elastic members. The other ends of the stretchable elastic members are fixed to two sides of the base. The rollers support and drive the pedal to reciprocate along the undulating slide rail ups and downs by means of the stretchable elastic members.

In some embodiments, because the undulating slide rail has the peak and the troughs, when the pedal is moved ups and downs, the pedal is reciprocated along the peak and the troughs of the slide rail.

In some embodiments, the highest point of the slide rail is defined as the peak. The two sides of the peak are provided with stop blocks, respectively. The bottoms of two ends of the peak are defined as the troughs each provided with a stop block.

In some embodiments, the stretchable elastic members are symmetrically disposed at two ends of the slide rail, and the stretchable elastic members provide a limiting effect for the slide rail. The stretchable elastic members can pull the pedal to the peak at the highest point of the slide rail.

In some embodiments, the base is formed with a pair of holes corresponding in position to the middles of two sides of the slid rail. Lower ends of the pair of stretchable elastic members are inserted through the pair of holes and fixed to a bottom of the base, respectively.

In some embodiments, the pair of stretchable elastic members is connected to the pedal and the base through positioning pins, respectively.

In some embodiments, the stop blocks are respectively mounted at the two sides of the peak or the bottom ends of the troughs of the slide rail. The stop blocks are made of a rubber or plastic material.

In some embodiments, an elastic cord is provided in each of the pair of stretchable elastic members for assisting in displacement.

In some embodiments, the stretchable elastic members may be a tension spring or an elastic cord.

According to the aforesaid, the present invention has the following advantages:

1. The present invention is provided with the stretchable elastic members to connect the pedal with the base in combination with the undulating slide rail, so that the connecting structure of the pedal and the base is simple and occupies less space and can be assembled and disassembled easily. When in use, on the one hand, the stretchable elastic members are forcedly stretched to increase the pedal strength of the user. On the other hand, the stretchable elastic members provide a return force to pull the pedal back. This facilitates the user to exercise ups and downs and improves the user's fitness and strength.

2. The stretchable elastic members have a physical property of a limited length of extension. The present invention uses the property of the stretchable elastic members to limit the moving range of the rollers and the pedal so as to improve the exercise safety.

3. The slide rail has an undulating shape. The highest point of the slide rail is defined as the peak. The bottoms of two ends of the peak are defined as the troughs. The troughs are disposed uphill relative to the peak. When the user slides one side of the pedal to the peak at the highest point, he/she can relax and wait for the pedal to slide to the lowest point of the trough by means of inertia force. At this time, the inertial force will drive the rollers to climb automatically. More importantly, the present invention may utilize the slope of the slide rail to assist the pedal in climbing. The pull force of the stretchable elastic member at the other side also assists the pedal in climbing.

4. The lower ends of the stretchable elastic members are inserted through the holes and fixed to the bottom of the base, thereby improving the stability and safety of the pedal.

5. The two sides of the peak of the slide rail or the bottom ends of the troughs at the two sides of the slide rail are provided with the stop blocks respectively, thereby limiting the moving range of the pedal and improving the safety for use.

DETAILED DESCRIPTION OF THE PREFERRED EMBODIMENTS

Figure 1:
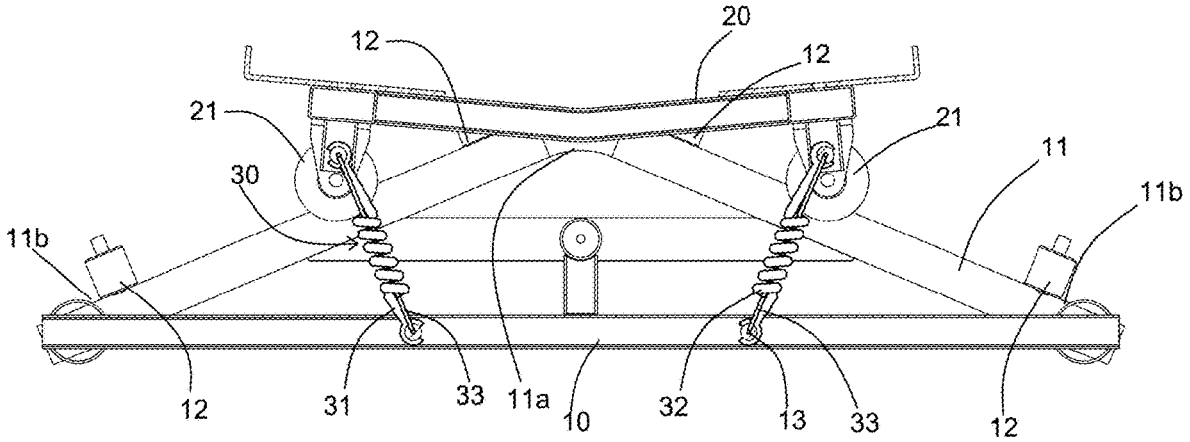
FIG. 1 is a structural schematic view of the present invention.
Figure 2:
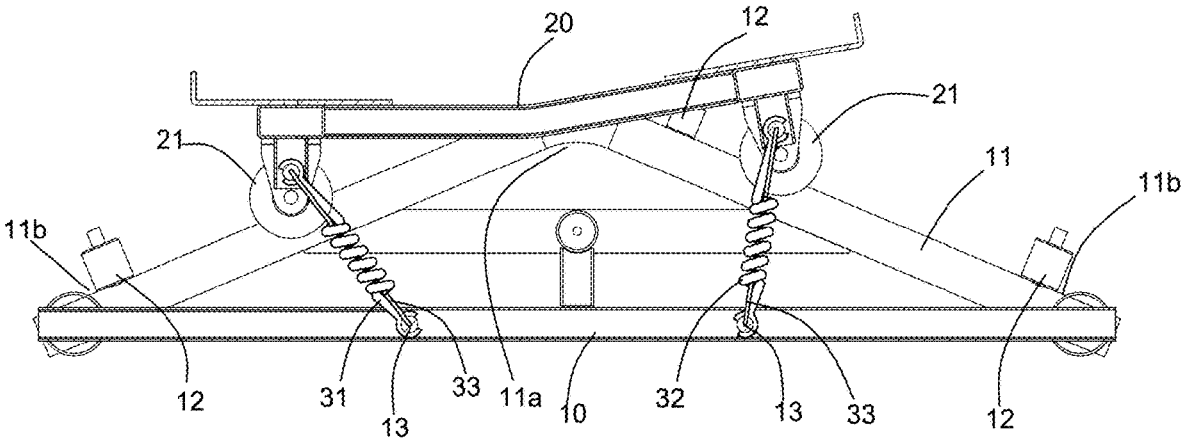
FIG. 2 and FIG. 3 are schematic views of the present invention when in use.
Figure 3:
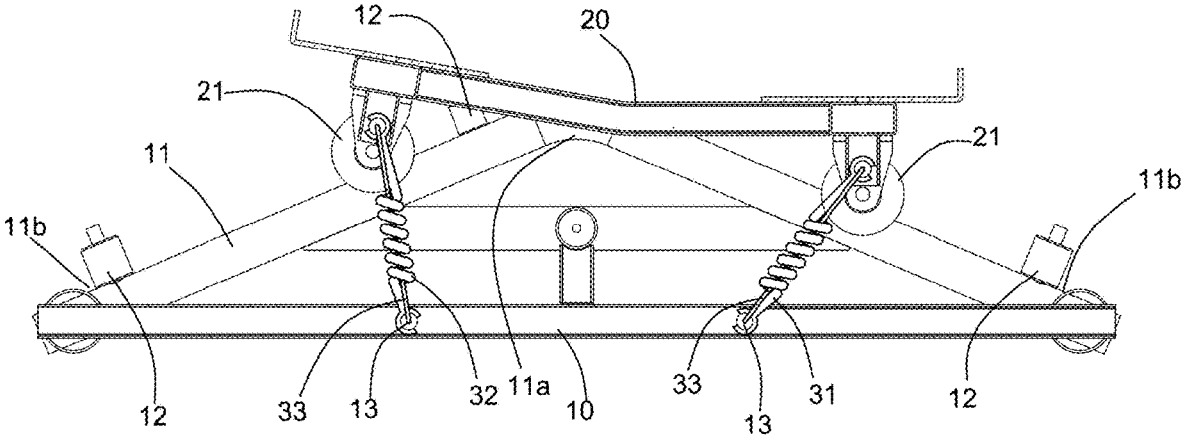
Figure 4:
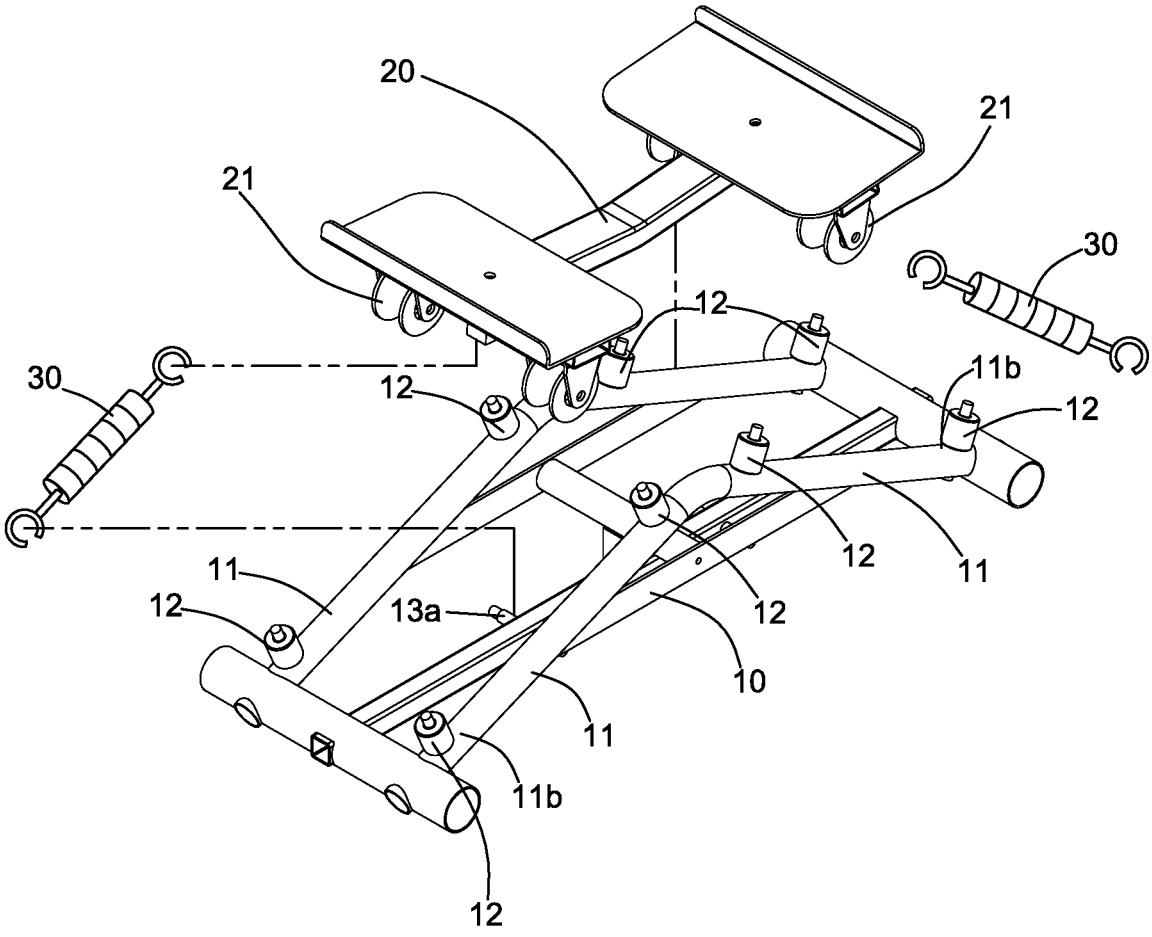
FIG. 4 is an exploded view of the present invention.

Embodiments of the present invention will now be described, by way of example only, with reference to the accompanying drawings.

Referring to FIG. 1 to FIG. 6, the present invention discloses a stepping exercise machine. The stepping exercise machine includes a base 10 and a pedal 20 which can be slid left and right as well as ups and downs on the base 10. The base 10 is provided with an undulating slide rail 11. The highest point of the slide rail 11 is defined as a peak 11*a*. The bottoms of two ends of the peak 11*a* are defined as troughs 11*b*, respectively. The troughs 11*b* are disposed uphill relative to the peak 11*a*. The highest point of the undulating slide rail 11 is defined as the peak 11*a*, and the lowest point of the bottom ends of two sides of the undulating slide rail 11 is defined as the trough 11*b*. Each of the troughs 11*b* is provided with a stop block 12. The pedal 20 may be one-piece or composed of left and right pedals, but not limited thereto. Two sides of the underside of the pedal 20 are pivotally connected with rollers 21. The rollers 21 support and drive the pedal 20 to slide along the undulating slide rails 11 back and forth as well as ups and downs. Two sides of the slide rail 11 are undulated symmetrically. Two sides of the peak 11*a* at the highest point of the slide rail 11 are provided with stop blocks 12 respectively, so that the roller 21 at one side of the slide rail 11 won't slide to the other side of the slide rail 11 to limit the moving range. The pedal 20 takes the peak 11*a* of the slide rail 11 as the highest point to image a symmetrical line. Therefore, the two sides of the slide rail 11 are disposed symmetrically, and the rollers 21 are also disposed symmetrically.

A pair of stretchable elastic members 30 is symmetrically disposed at the two sides of the undulating slide rail 11. The pair of stretchable elastic members 30 includes a left stretchable elastic member 31 and a right stretchable elastic member 32 which are symmetrically disposed at the two sides of the slide rail 11. The base 10 is formed with a pair of holes 13 corresponding in position to the middles of the two sides of the slid rail 11. The holes 13 are symmetrically connected with the left stretchable elastic member 31 and the right stretchable elastic member 32. Lower ends of the left stretchable elastic member 31 and the right stretchable elastic member 32 are inserted through the holes 13 and fixed to the bottom of the base 10 through positioning pins 13*a*, respectively. Upper ends of the left stretchable elastic member 31 and the right stretchable elastic member 32 are symmetrically connected to the two sides of the underside of the pedal 20. Furthermore, an elastic cord 33 may be provided in each stretchable elastic member 30 for assisting in displacement. Further, the pair of stretchable elastic member 30 may include more than one pair of stretchable elastic members 30 symmetrically disposed between the two sides of the underside of the pedal 20 and the base 10 for adjusting the tensile resistance.

The rollers 21 support and drive the pedal 20 to slide along the undulating slide rail 11 back and forth as well as ups and downs by means of the stretchable elastic members 30. When the pedal 20 is undulated, the wave curvature is formed along the two ends of the slide rail 11.

Figure 5:
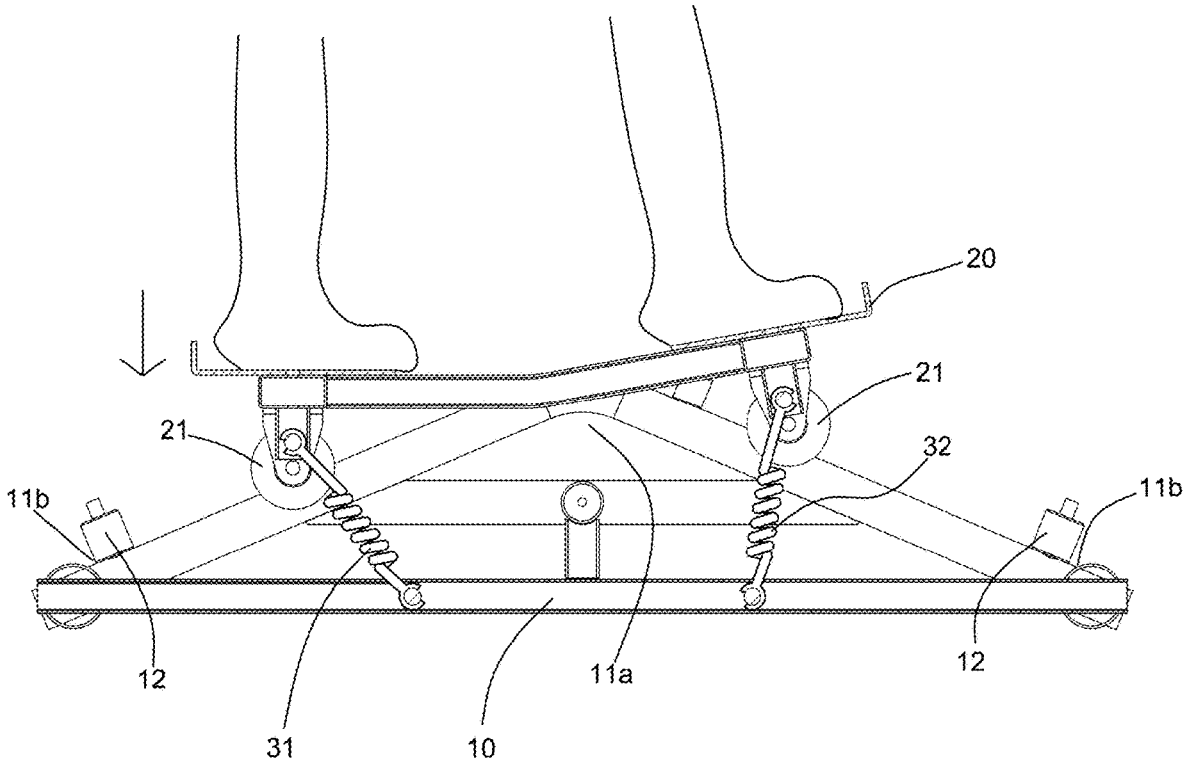
FIG. 5 and FIG. 6 are further schematic views of the present invention when in use.
Figure 6:
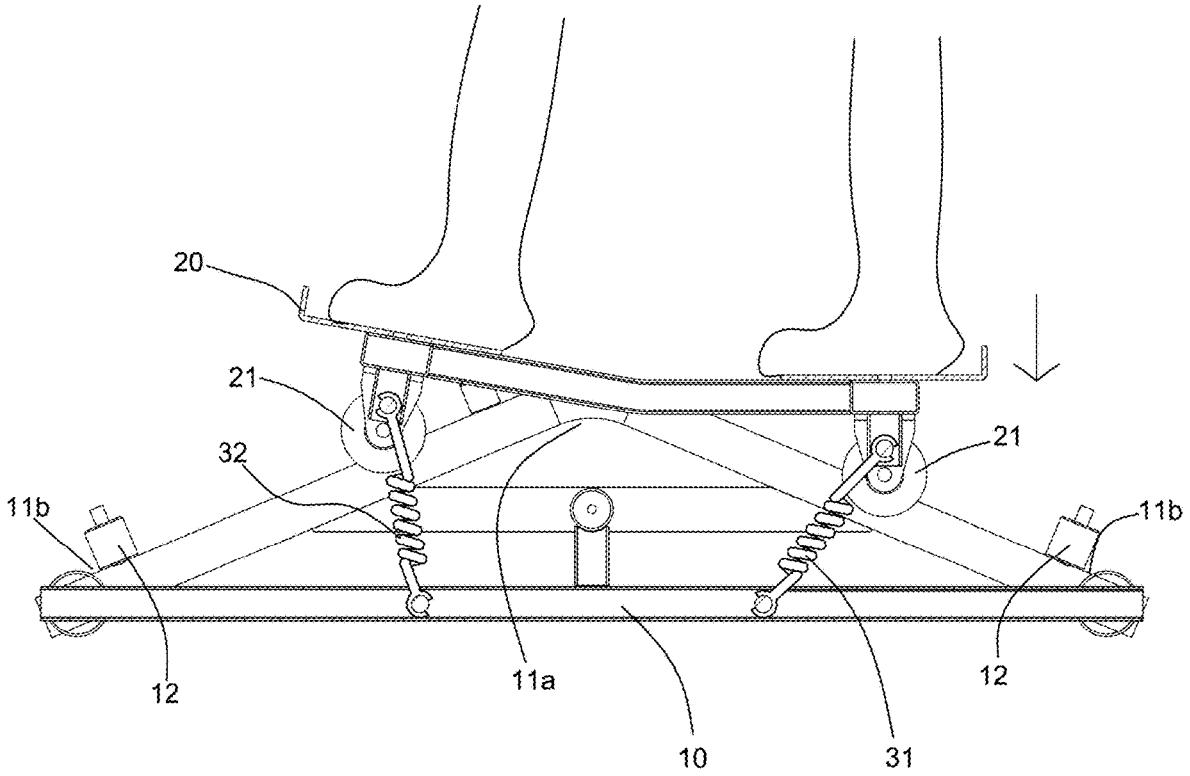

As shown in FIG. 1, when the stepping exercise machine is not in use, the left and right stretchable elastic members 31, 32 don't generate a tensile force so that the pedal 20 is restrained on top of the peak 11*a* of the slide rail 11. When in use, as shown in FIG. 5 and FIG. 6, the user can slide left by pedaling the pedal 20, and the right stretchable elastic member 32 is forcedly stretched to increase the pedal strength of the user. The pedal 20 applied with a force by the user's feet drives the left roller 21 to move down along the left side of the slide rail 11 to the left trough 11*b*, and the right roller 21 of the pedal 20 is moved up along the right side of slide rail 11 from the right trough 11*b*. After that, when the pedal 20 is slid right, the left stretchable elastic member 13 is forcedly stretched to increase the pedal strength of the user. The pedal 20 is reciprocated left and right and ups and downs to achieve a full-body workout.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An exercise stepper comprising: a base and a pedal, the base being provided with an undulating slide rail having a peak and two troughs at two sides of the peak, an underside of the pedal being pivotally connected with rollers, two sides of the underside of the pedal being connected with a pair of stretchable elastic members at one end of the stretchable elastic members, respectively, another end of the stretchable elastic members being fixed to two sides of the base; the rollers supporting and driving the pedal to reciprocate along the undulating slide rail, up and down, via the stretchable elastic members, and wherein the two sides of the peak of the slide rail are provided with stop blocks and the troughs at two sides of the slide rail are provided with stop blocks.

2. The exercise stepper as claimed in claim 1, wherein the pair of stretchable elastic members is symmetrically disposed between the two sides of the underside of the pedal and the base.

3. The exercise stepper as claimed in claim 2, wherein the base is formed with a pair of holes corresponding in position to middle portions of two sides of the slide rail, and lower ends of the pair of stretchable elastic members are inserted through the pair of holes and fixed to a bottom of the base, respectively.

4. The exercise stepper as claimed in claim 3, wherein the pair of stretchable elastic members is connected to the pedal and the base through positioning pins, respectively.

5. The exercise stepper as claimed in claim 2, wherein the pair of stretchable elastic members include more than one pair of stretchable elastic members connected between the two sides of the underside of the pedal and the base.

6. The exercise stepper as claimed in claim 1, wherein an elastic cord is provided in each of the pair of stretchable elastic members for assisting in displacement.

* * * * *